US005901952A

United States Patent [19]

Hourtash

[11] Patent Number: 5,901,952

[45] Date of Patent: May 11, 1999

[54] PAPER SIZE ADJUSTING APPARATUS FOR A PAPER SUPPLY TRAY

[75] Inventor: Arjang M. Hourtash, San Diego, Calif.

[73] Assignee: Hewlett-Packard Company, Palo Alto, Calif.

[21] Appl. No.: 08/710,150

[22] Filed: Sep. 12, 1996

[51] Int. Cl.[6] ..... B65H 1/00

[52] U.S. Cl. ..... 271/171

[58] Field of Search ..... 271/171, 223

[56] References Cited

U.S. PATENT DOCUMENTS

| | | | |
|---|---|---|---|
| 3,652,083 | 3/1972 | Bosshardt | 271/39 |
| 4,457,506 | 7/1984 | Ashbee et al. | 271/3.1 |
| 4,575,067 | 3/1986 | Ciatteo | 270/58 |
| 4,786,042 | 11/1988 | Stemmle | 271/171 X |
| 5,188,351 | 2/1993 | Gysling | 271/171 |
| 5,297,787 | 3/1994 | Shirai | 271/171 |
| 5,354,044 | 10/1994 | Fiel et al. | 275/4 |
| 5,454,553 | 10/1995 | Fiel et al. | 271/4.04 |

*Primary Examiner*—David H. Bollinger

[57] ABSTRACT

Briefly and in general terms a paper size adjusting apparatus for a paper supply tray. The apparatus includes a paper supply tray having a bottom wall, left and right side walls, a front wall and a rear wall; a side wall paper guide laterally movable with respect to and connected to the supply tray; and a front wall paper guide longitudinally moveable with respect to and connected to the supply tray. The apparatus further includes a mechanical connector that engages both the paper guides in a manner such that the movement of one of the guides generates a corresponding movement of the other guide. The apparatus provides for a coupled width and length adjustment thereby allowing the user to conform both dimensions with only one manipulation.

13 Claims, 10 Drawing Sheets

PAPER SIZE ADJUSTING APPARATUS FOR A PAPER SUPPLY TRAY

FIELD OF INVENTION

The present invention generally relates to sheet feeding mechanisms for use in computer controlled printers, and more particularly, to means for alignment of sheets in media supply trays of such printers.

BACKGROUND OF INVENTION

Paper supply trays are used in printers, such as ink-jet or laser printers, to support and align the media for feeding into the printer. The paper supply tray aligns the paper in two dimensions, width and length. In operation, a paper stack is manually placed in the paper supply tray. The tray is then securely positioned adjacent the printer. This positioning places the paper stack adjacent the paper picking mechanism within the printer. The paper picking mechanism operates by picking the top sheet from the stack and forcing the sheet into the printer.

In the art of printing it is desirable for the printer to accommodate different sizes of paper or other media such as overhead projector transparency film. Examples of papers with different dimensions include: "A" size, 8½ inch×11 inch, commonly referred to as U.S. letter size; "A4" size, 210 mm×297 mm, commonly referred to as international letter size; and 8½ inch×14 inch, commonly referred to as legal size.

It is important that the width and length dimensions of the paper are correctly aligned in the supply tray. Lack of proper alignment can prevent the paper from being fed into the printer feed mechanism or cause the paper to be fed in a skewed orientation. This skew, in turn, can lead to either a jam in the feed mechanism or a distorted printed page. Several methods have been used by printer manufacturers to address the problem of matching the paper supply tray to different sizes of paper. In one approach, a unique tray is designated for each paper size that the printer accommodates. This will insure that the right size paper is inserted in a given tray. This approach, however, has several disadvantages. The disadvantages to the manufacturer or reseller are increased cost in molding numerous sized and configured trays, and increased cost in maintaining inventory of multiple trays. To the user, the disadvantages include storing trays not presently in use; purchasing, often at an additional cost, trays which are not initially provided with the printer; and interchanging of paper trays to accommodate different sizes of paper.

Another approach, allows the manufacturer to produce one paper supply tray that can be configured for the various sizes of paper. This approach reduces manufacturing cost by requiring only one mold for all paper trays. However, these trays require two separate adjustments, one to adjust for the length and the other to adjust for the width of the paper. Two adjustments are not only cumbersome, but also many times the user does not change the width adjustment either out of unawareness or forgetfulness. Lack of correct adjustment, as stated above, can prevent the paper from being fed into the printer or cause the paper to be fed in a skewed orientation.

It will be apparent from the foregoing that although there are many paper supply tray apparatus for supporting and aligning media, there is still a need for a design that provides low manufacturing cost and ease of use.

SUMMARY OF THE INVENTION

Briefly and in general terms a paper size adjusting apparatus for a paper supply tray includes a paper supply tray having a bottom wall, left and right side walls, a front wall and a rear wall, said walls being immovable with respect to each other; a side wall paper guide laterally movable with respect to and connected to the supply tray; a front wall paper guide longitudinally moveable with respect to and connected to the supply tray; and a mechanical connector that engages both paper guides in a manner so that movement of one guide generates corresponding movement of the second guide, thereby adjusting the tray for papers of differing sizes.

The coupled adjustment of the paper in both its lateral and longitudinal dimensions provides for a more reliable paper supply tray with lower cost and higher ease of use than the conventional paper supply trays.

DESCRIPTION OF THE PREFERRED EMBODIMENT

Figure 1:
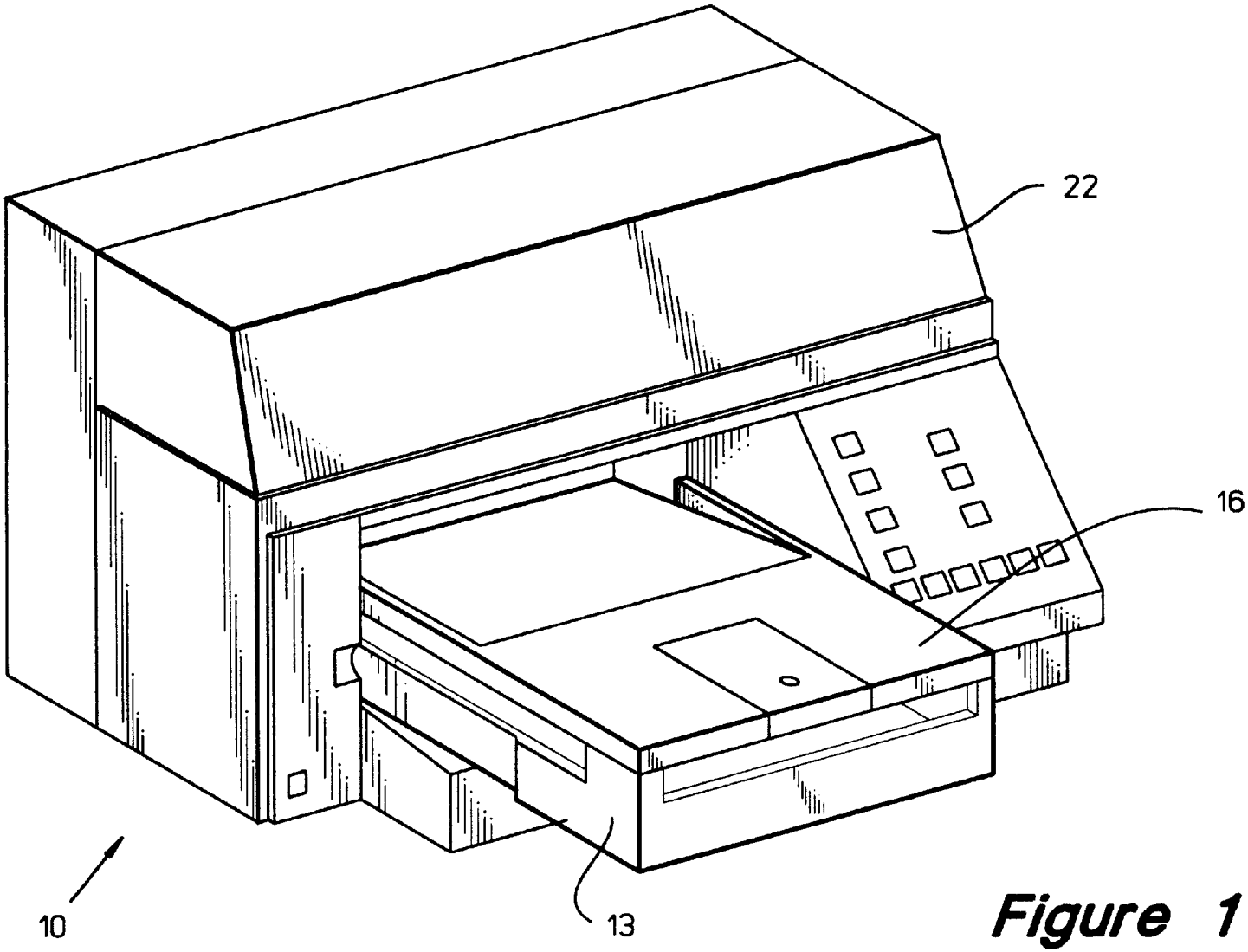
FIG. 1 is an isometric view of a printer embodying the present invention, showing the front of the printer.
Figure 2:
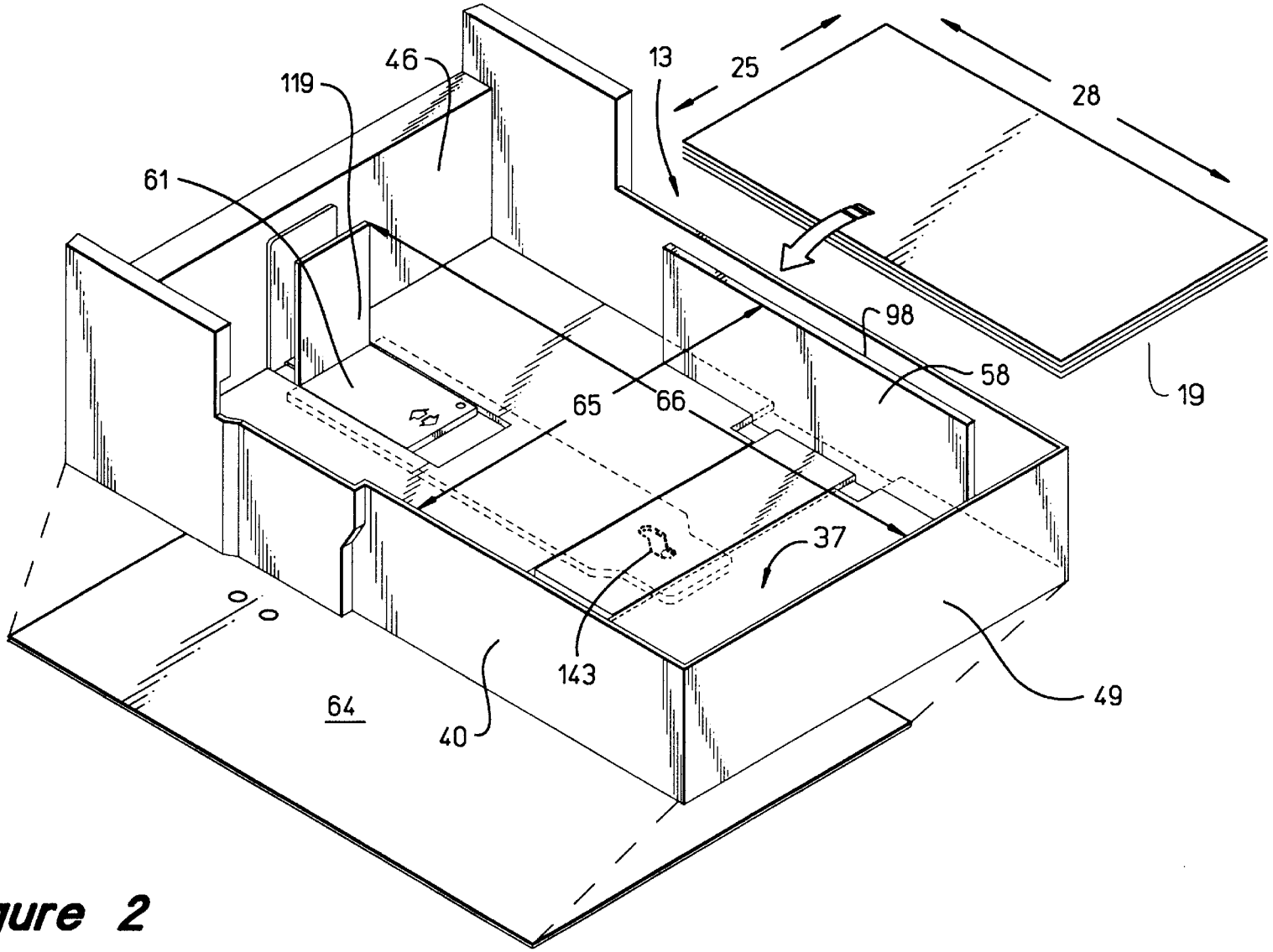
FIG. 2 is an isometric view of a paper supply tray for the printer of FIG. 1. Note the top cover is not shown and the bottom wall is displaced for clarity.

FIG. 1 illustrates the external features of a printer 10 embodying the invention. The printer 10 has a paper supply tray 13 and an output tray 16. Printing media such as a plurality of cut sheet paper 19, FIG. 2, are stacked in the paper supply tray 13 for use in the printer. Upon completion of the printing process, the paper 19 is received in the output tray. A top cover 22 of the printer is shown in the closed position. The paper 19 has a lateral dimension 25 and a longitudinal dimension 28, FIG. 2. These dimensions vary depending on the size of paper chosen, such as "A" or "A4".

FIG. 2 illustrates a slideable side wall paper guide 58 laterally movable with respect to and connected to the supply tray 13, and a slideable front wall paper guide 61 longitudinally moveable with respect to and connected to the supply tray 13. The paper guides 58 and 61 are connected via a cam system 143. The paper guides 58 and 61, and the cam system 143, together, provide a coupled means for aligning the paper 19 in its lateral and longitudinal dimensions, 25 and 28, respectively. The paper supply tray 13 and the paper guides 58 and 61 and all of their components are made of moldable plastic.

Figure 3A:
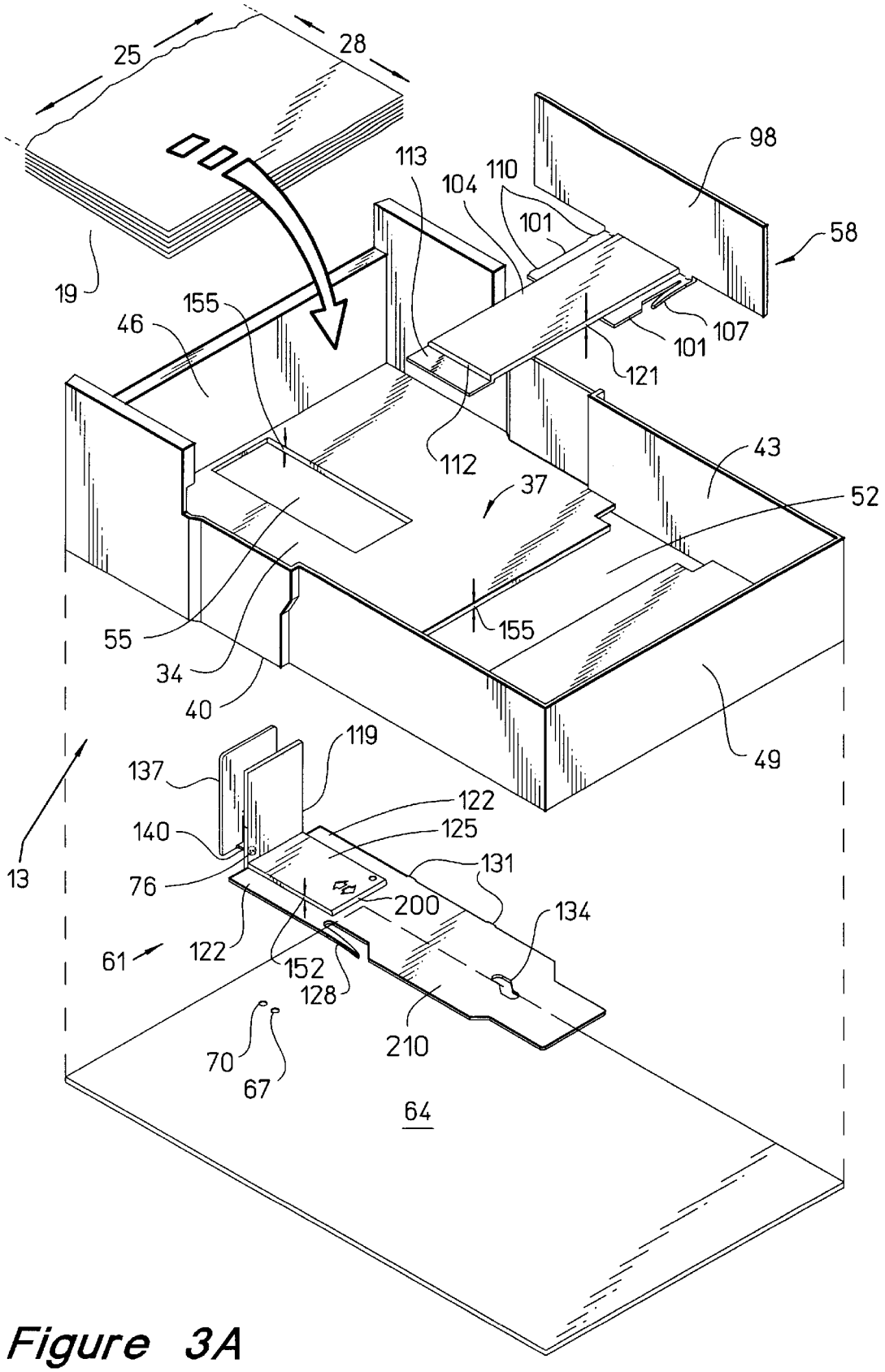
FIG. 3A is an exploded view of the paper supply tray of FIG. 2.

Referring to FIG. 3A, the paper supply tray 13 has the following molded parts: a horizontally extending bottom wall 37, a right side wall 40, a left side wall 43, a front wall 46, and a rear wall 49 facing the printer 10, together providing the means for housing and supporting the paper 19. The bottom wall 37 has a bottom surface 31, FIG. 4, and a top surface 34. The bottom wall 37 has a side wall opening 52 and a front wall opening 55, for receiving the side wall paper guide 58 and the front wall paper guide 61, respectively. The openings 52 and 55 have a thickness 155.

Figure 4:
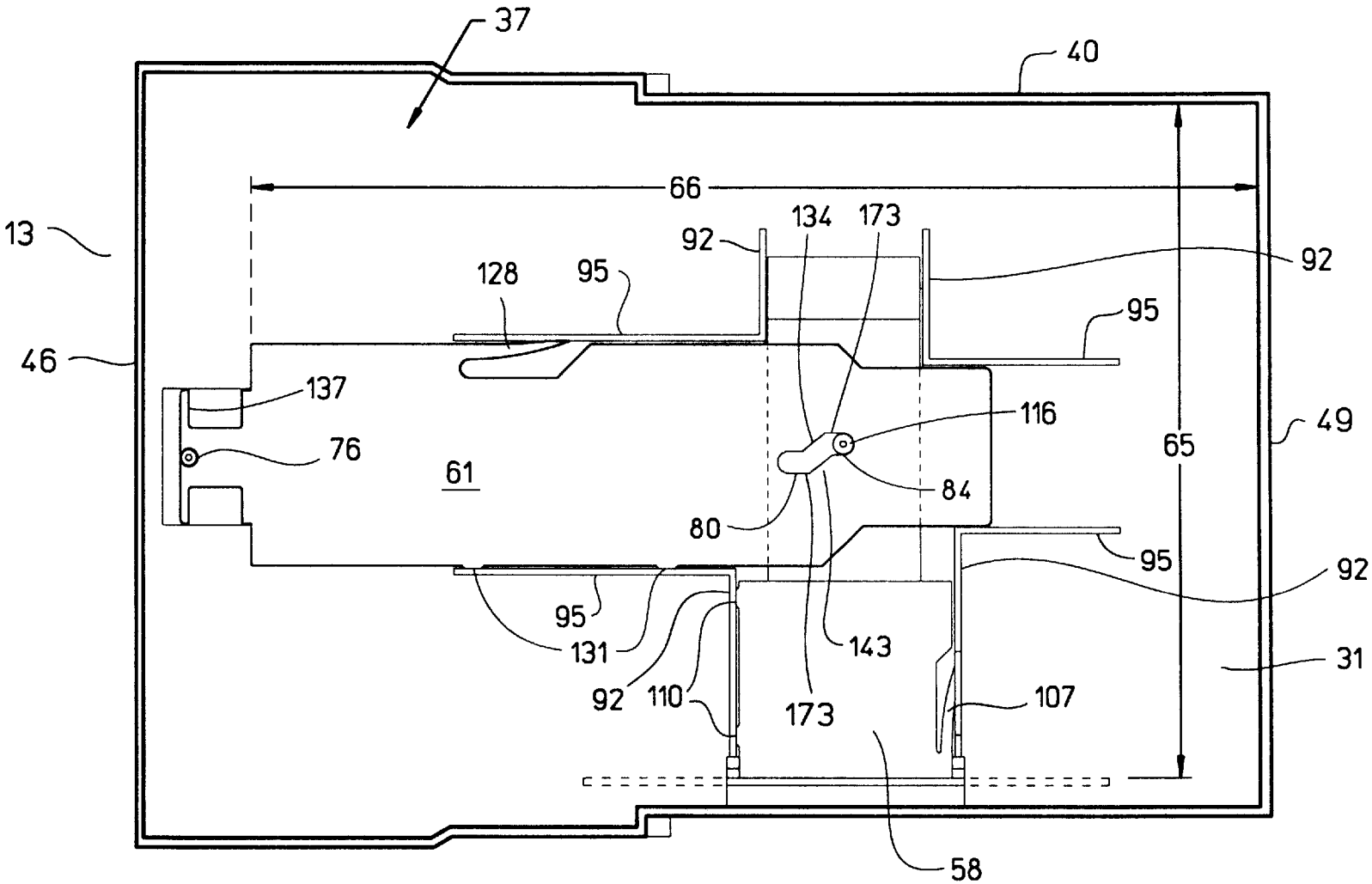
FIG. 4 is a bottom plan view of the paper supply tray of FIG. 2, in "A4" size position. Note the base is displaced for clarity.

Referring to FIG. 4, on the bottom surface 31 of the bottom wall 37 there are a pair of parallel integrally molded lateral alignment rails 92 and a pair of parallel integrally molded longitudinal alignment rails 95. Alignment rails 92 and 95 function as tracks to guide and constrain the movement of paper guides 58 and 61 in the lateral and longitudinal direction with respect to the supply tray 13, respectively.

Referring back to FIG. 3A, the bottom wall 37 is covered on its bottom surface 31 by a horizontally extending base 64. The base 64 serves as a support for the paper supply tray 13 and the paper guides, 58 and 61. The base 64 has a plurality of engagement slots 67 and 70 for engaging an anchoring pin 76 located on a bottom surface of the front wall paper guide 61, FIG. 3C. The engagement slots 67 and 70 correspond to "A" and "A4" size papers, respectively. It should be noted that in FIG. 4 the base 64 is not shown for clarity.

Figure 3B:
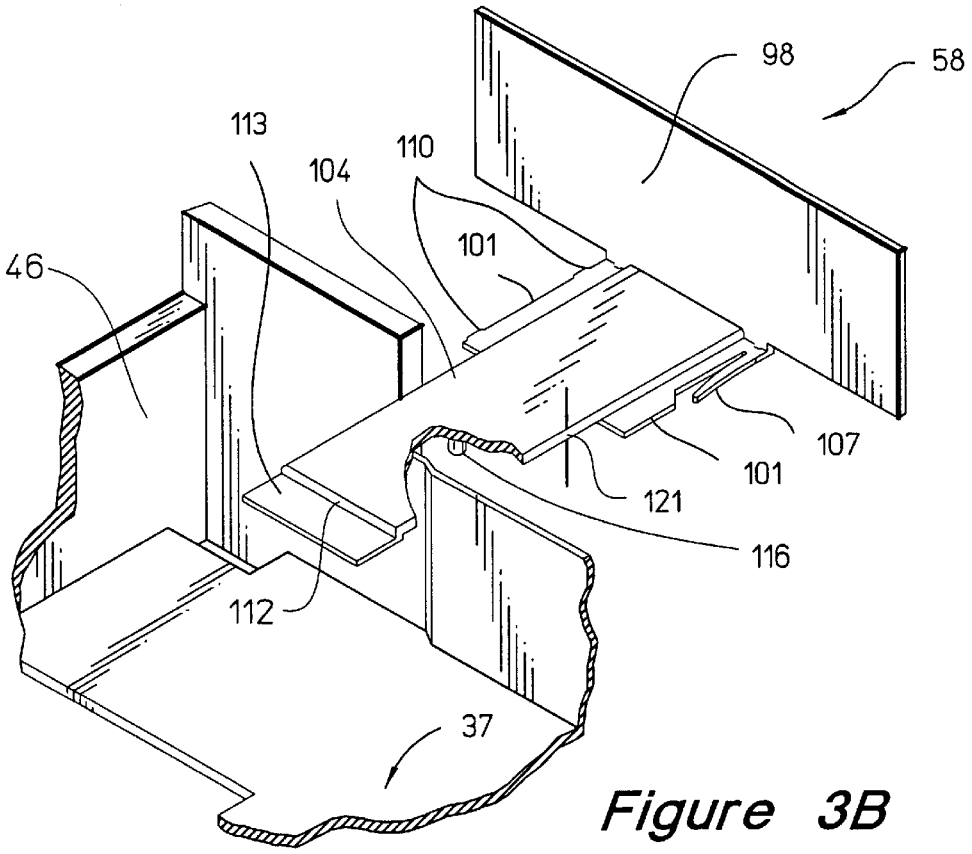
FIG. 3B is a partially cutaway view of the side wall paper guide of FIG. 3A, showing a cam follower.

FIG. 3A and 3B illustrate the side wall paper guide 58 and its integrally molded components. Reference numeral 98 indicates an upstanding side wall paper guide panel. The side wall paper guide panel 98 and the right side wall 40 of the paper supply tray 13 constrain the paper 19 in its lateral dimension 25. A horizontally extending side wall paper guide shelf 104 is at right angle to panel 98 and has a thickness 121 that is about the same as the thickness 155 of the side wall opening 52, FIG. 3A. The side wall paper guide shelf 104, upon assembly, sits in the side wall opening 52 and is flush with the top surface 34 of the bottom wall 37 to provide a smooth surface for supporting the paper 19, FIG. 2. The shelf 104 on its bottom surface has a cam follower pin 116, FIG. 3B, as part of the cam system 143, FIG. 4.

Referring to FIGS. 3A and 3B, a depressed side wall paper guide mantel 113 extends from and is depressed with respect to the side wall paper guide shelf 104. The mantel 113, upon assembly, rests below the bottom wall 37. The mantel 113 and the shelf 104 at their junction form a step 112. The step 112 serves as a stop for the side wall paper guide 58 as it moves towar d the right side wall 40.

Referring to FIGS. 3A and 3B, a pair of horizontally extending side wall paper guide fins 101 extend from and are depressed with respect to the side wall paper guide shelf 104. The fins 101, upon assembly, are positioned between the bottom wall 37 and the base 64 thereby securing the side wall paper guide 58 as the side wall paper guide 58 rests in the side wall opening 52.

Referring to FIGS. 3A and 3B, a resilient arcuate side wall paper guide spring member 107 is integrally built on and protrudes from one of the fins 101 closest to the rear wall 49 of the paper supply tray 13 for urging the side wall paper guide 58 against the lateral alignment rail 92 closest to the rear wall 49. The side wall paper guide 58 requires a clearance as it moves against the alignment rails 92. However, if no accommodations are made, this clearance can lead to slop as the side wall paper guide 58 moves. The spring 107 takes up the slop by applying the necessary force on the lateral alignment rails 92, thus constraining the side wall paper guide 58 during its movement, FIG. 4.

Referring to FIGS. 3A and 3B, a pair of side wall paper guide alignment shoulders 110 are integrally built onto and project from one of the fins 101 closest to the front wall 46 of the paper supply tray 13 for engaging the side wall alignment rail 92 closets to the front wall 46, FIG. 4. The alignment shoulders 110 provide a solid constrain between the side wall paper guide 58 and the lateral alignment rails 92 thereby keeping the side wall paper guide 58 sliding smoothly against the alignment rails 92, FIG. 4, and aiding in relaxing the tolerance requirements for manufacturing the side wall paper guide 58 with straight edges.

Figure 3C:
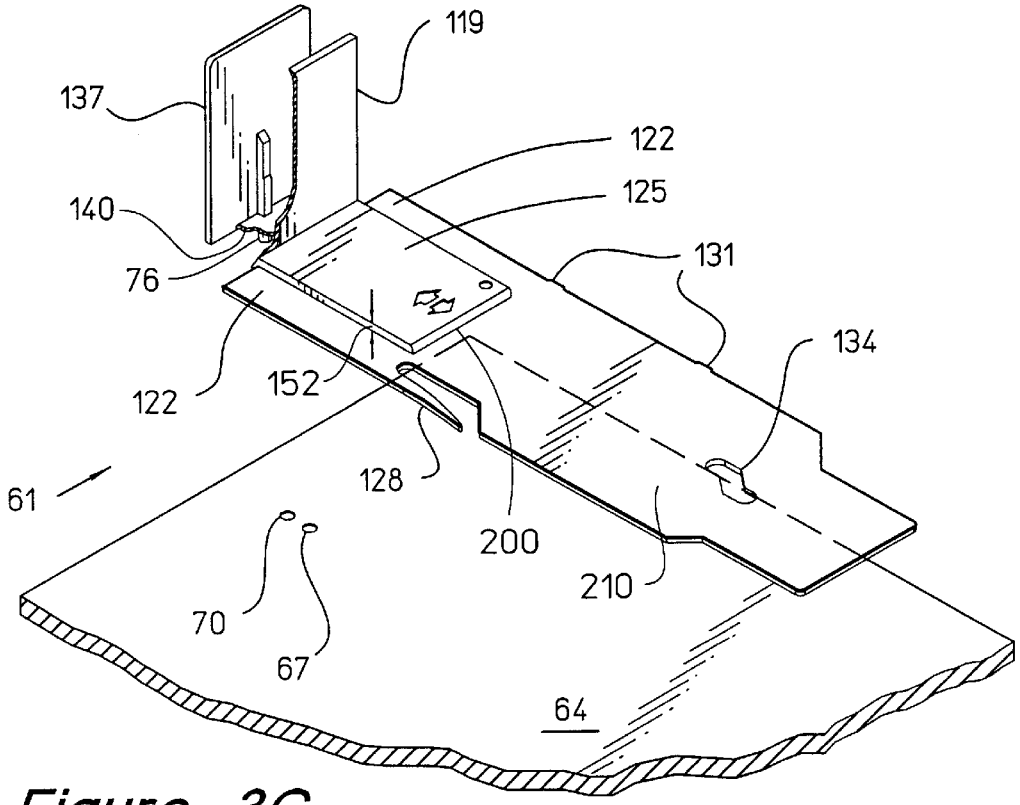
FIG. 3C is a partially cutaway view of the front wall paper guide of FIG. 3A, showing an anchoring pin.

FIGS. 3A and 3C illustrate the front wall paper guide 61 and its integrally molded components. Reference numeral 119 indicates an upstanding front wall paper guide panel. The front wall paper guide panel 119 and the rear wall 49 of the paper supply tray 13 constrain the paper 19 in its longitudinal dimension 28. A flexible arm 140 is attached to the front wall paper guide panel 119. The anchoring pin 76, FIG. 3C, is located on the bottom surface of the flexible arm 140 for engaging the engagement slots 67 or 70 of the base 64. A wall 137 for moving the front wall paper guide 61 is connected to the front wall paper guide panel 119 by the flexible arm 140 such that when the wall 137 is pushed toward the front wall paper guide panel 119, the arm 140 flexes causing the wall 137 to pivot upward and thereby disengaging the anchoring pin 76 from the engagement slots 67 or 70.

Referring to FIG. 3C, a horizontally extending front wall paper guide shelf 125 is at right angle to the front wall paper guide panel 119 and has a thickness 152 that is about the same as the thickness 155 of the front wall opening 55, FIG. 3A. The front wall paper guide shelf 125, upon assembly, sits in the front wall opening 55 and is flush with the top surface 34 of the bottom wall 37 to provide a smooth surface for supporting the paper 19, FIG. 2.

Referring to FIG. 3C, a pair of horizontally extending front wall paper guide fins 122 extend from and are depressed with respect to the front wall paper guide shelf 125. The fins 122, upon assembly, are positioned between the bottom wall 37 and the base 64 thereby securing the front wall paper guide 61 as the front wall paper guide 61 rests in the front wall opening 55.

Referring to FIG. 3C, a resilient arcuate front wall paper guide spring member 128 is integrally built on and protrudes from one of the fins 122 closest to the right side wall 40 of the paper supply tray 13 for urging the front wall paper guide 61 against the longitudinal alignment rail 95 closest to the right side wall 40. The front wall paper guide spring member 128 cooperates with the longitudinal alignment rails 95 in the same manner that the side wall paper guide spring member 107 cooperates with the lateral alignment rails 92 described above.

A pair of front wall paper guide alignment shoulders 131 are integrally built onto and project from one of the fins 122 closest to the left side wall 43 of the paper supply tray 13. The front wall alignment shoulders 131 cooperate with the longitudinal alignment rails 95 in the same manner that the side wall paper guide alignment shoulders 110 cooperate with the lateral alignment rails 92 described above.

A depressed front wall paper guide mantel 210 extends from and is depressed with respect to the front wall paper guide shelf 125, and upon assembly, rests below the bottom wall 37 and above the base 64, FIG. 2. The mantel 210 and the shelf 125 at their junction form a step 131. The step 200 serves as a stop for the front wall paper guide 61 as it moves toward the rear wall 49.

Figure 5:
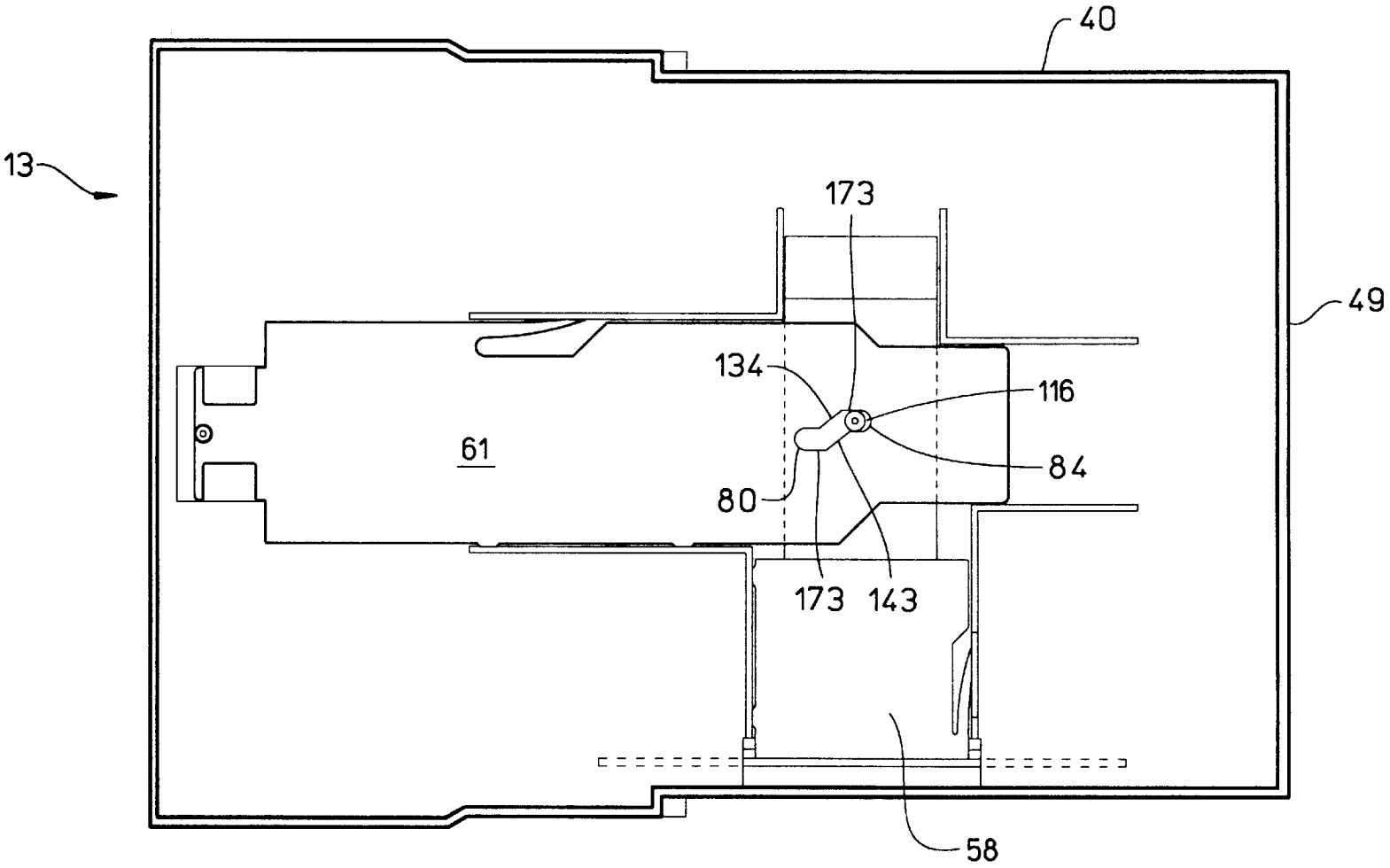
FIG. 5 is a bottom plan view of the cam follower of FIG. 2, in flat regions of a cam surface. Note the base is displaced for clarity.

Referring to FIG. 3C and 4, a cam surface 134, having a generally sigmoid shape interior surface within the front wall paper guide mantel 210, engages the cam follower 116. The cam surface 134 has an obtuse angle between a first paper adjustment position 80 and a second paper adjustment position 84. The paper adjustment positions 80 and 84 correspond to "A" and "A4" sizes of paper, respectively. The cam surface 134 and the cam follower 116, together, make up the cam system 143. In FIG. 4, the cam follower 116 is positioned in the cam surface 134 to accommodate "A4" size paper as indicated by reference numeral 84. The cam surface 134 has two parallel longitudinal surfaces 173. The parallel longitudinal surfaces 173 have a length that is greater than the diameter of the cam follower pin 116, FIG. 4. The parallel surfaces 173 act as a stop to prevent the translation of slight longitudinal movements into unwanted lateral movements if the front wall paper guide 61 is unintentionally moved during its handling. This stop function prevents skewing of paper 19 as the paper 19 rests in the paper supply tray 13. FIG. 5 illustrates the cam follower 116 in one of the flat regions 173 which is well within the "A4" size setting. It should be noted that in FIG. 5 the base 64 is not shown for clarity.

Figure 6:
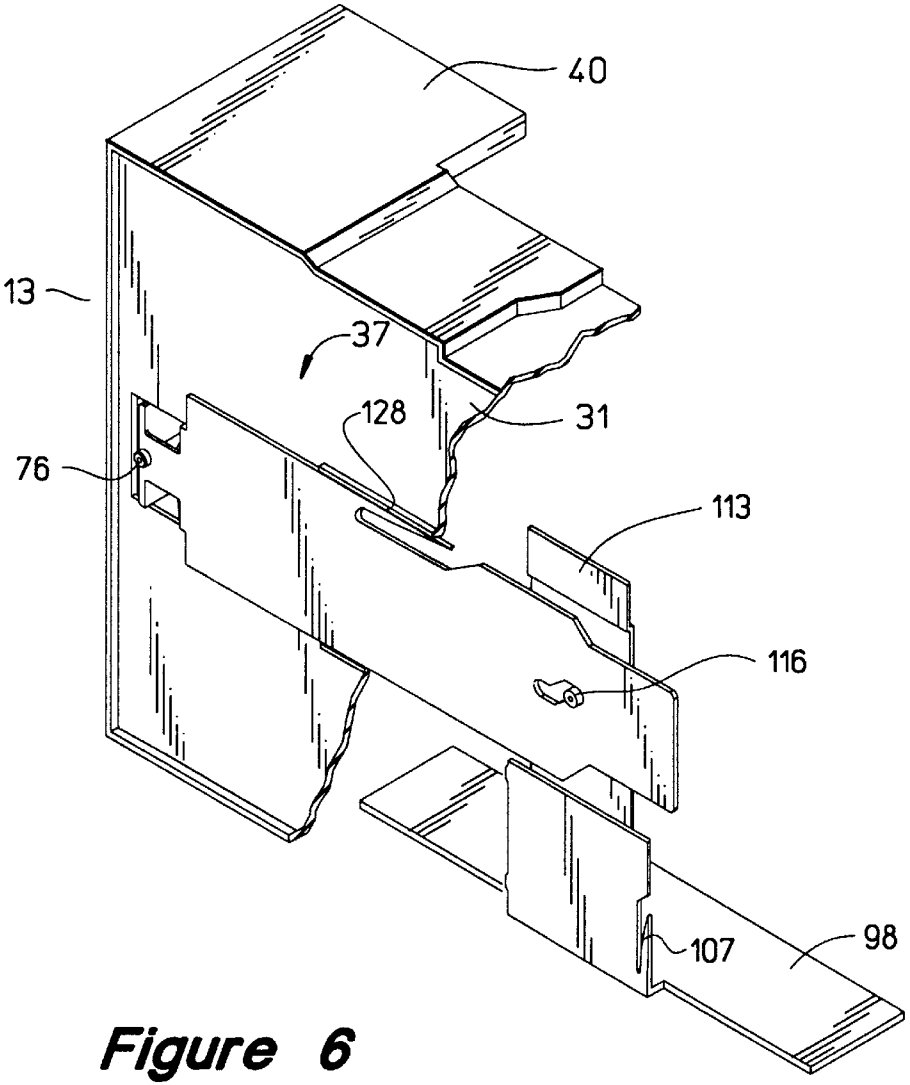
FIG. 6 is a partially cutaway view of the assembled paper supply tray of FIG. 2. Note the base is displaced for clarity.

FIGS. 2 and 6 representing the paper supply tray 13 after assembly, in combination with FIGS. 3A, 3B, and 3C, illustrate the construction of the paper supply tray 13. The side wall paper guide 58 is inserted, from above the bottom wall 37, into the side wall opening 52. The side wall paper guide fins 101 push up against the bottom surface 31 of the bottom wall 37. The side wall paper guide shelf 104 is flush with the top surface 34 of the bottom wall 37. It should be noted that in FIG. 6 the base 64 has been removed for clarity.

The front wall paper guide 61, is inserted, from below the bottom wall 37, through the front wall opening 55. The front wall paper guide fins 122 push up against the bottom surface 31 of the bottom wall 37. The front wall paper guide shelf 125 is flush with the top surface 34 of the bottom wall 37. The side wall paper guide 58 rests, orthogonally, on the front wall paper guide 61 such that the cam follower 116 is engaged in the cam surface 134. The base 64 covers, from below, the front wall paper guide 61 and the paper supply tray 13.

Figure 7:
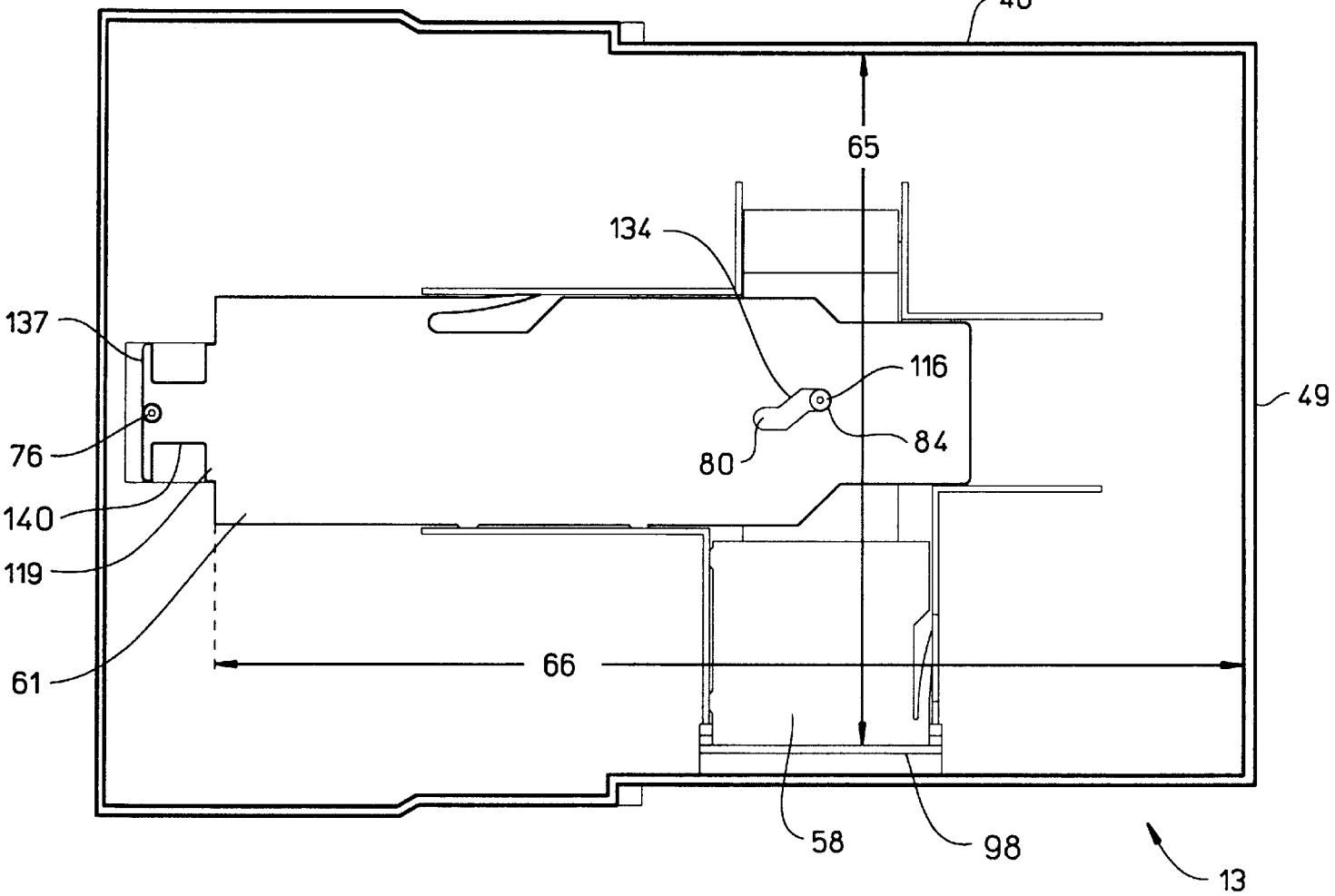
FIG. 7 is a bottom plan view of the paper supply tray of FIG. 2, and its inside dimensions in "A4" position. Note the base is displaced for clarity.
Figure 8:
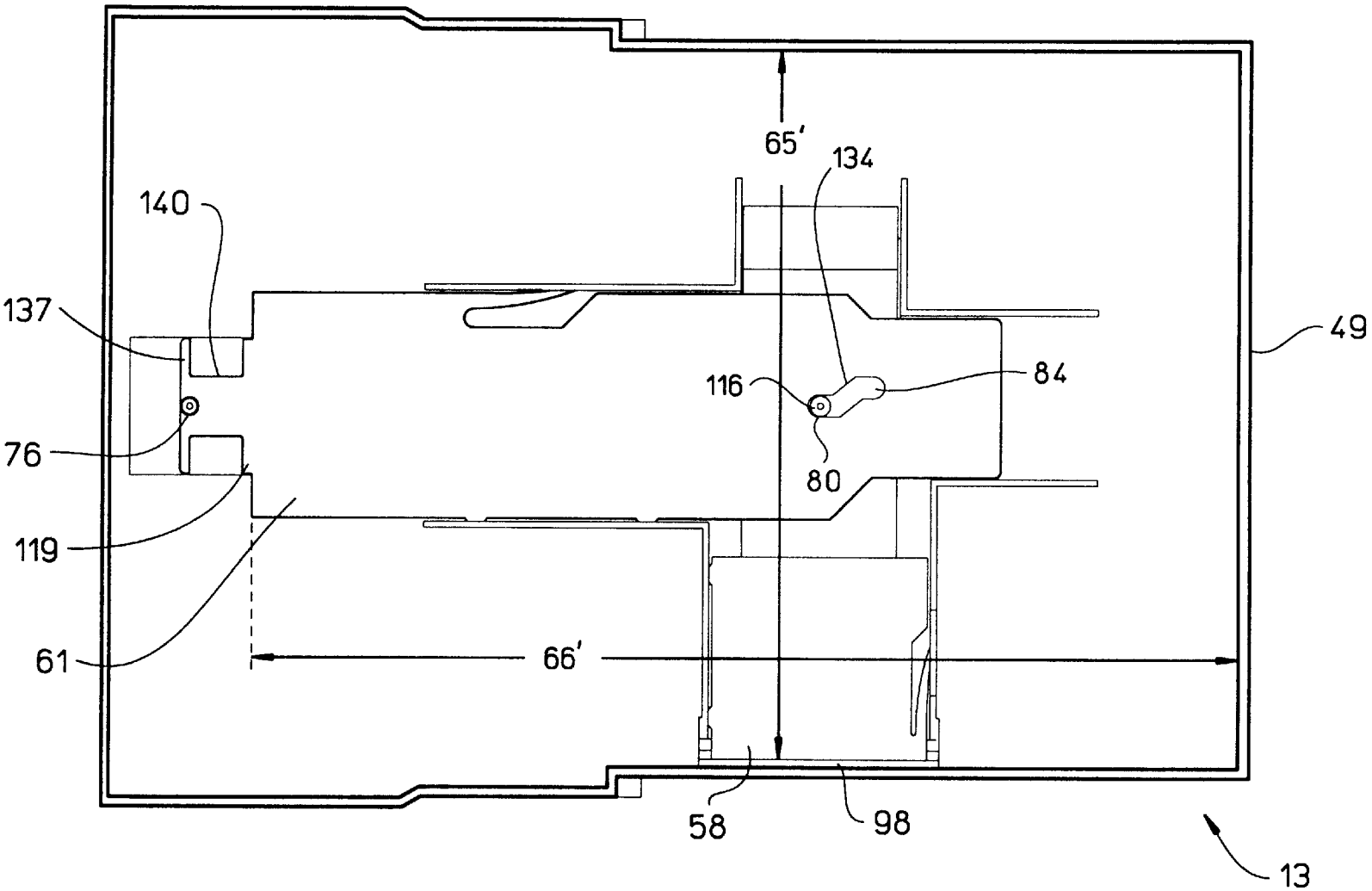
FIG. 8 is a bottom plan view of the paper supply tray of FIG. 2, and its inside dimensions in "A" size position. Note the base is displaced for clarity.

In operation, FIGS. 7 and 8 represent the paper supply tray 13 changing from the "A4" size setting to "A" size setting. At start, as illustrated in FIG. 7 and indicated by reference numeral 84, the paper supply tray is engaged to receive "A4" size paper. In the "A4" setting inside dimensions 65 and 66 are about 210 and 297 mm, respectively. To modify the paper supply tray 13 to receive "A" size paper, the wall 137 is pushed toward the front wall paper guide panel 119 causing the arm 140 to flex which in turn causes the wall 137 to pivot upward, thereby disengaging the anchoring pin 76 from the engagement slot 70, FIG. 3A. The wall 137, the front wall paper guide panel 119, the front wall paper guide 61, and the cam surface 134 are pushed toward the rear wall 49 of the paper supply tray 13. As the cam surface 134 moves, the cam follower 116 moves along the inside surface of the cam 134. The movement of the cam follower 116 along the cam surface 134 pushes the side wall paper guide 58 away from the right side wall 40 to accommodate the larger width "A" size paper. When the anchoring pin 76 reaches the "A" size engagement slot 67, as marked on the base 64 of the paper supply tray 13 in FIG. 3A, the wall 137 is released, placing the anchoring pin 76 in the engagement slot 67 and the cam follower 116 in its "A" size position, as indicated by reference numeral 80 in FIG. 8. In this position, as illustrated in FIG. 8, inside dimensions 65' and 66' are about 8½ and 11 inch, respectively. It should be noted that in FIGS. 7 and 8 the base 64 is not shown for clarity.

Figure 9:
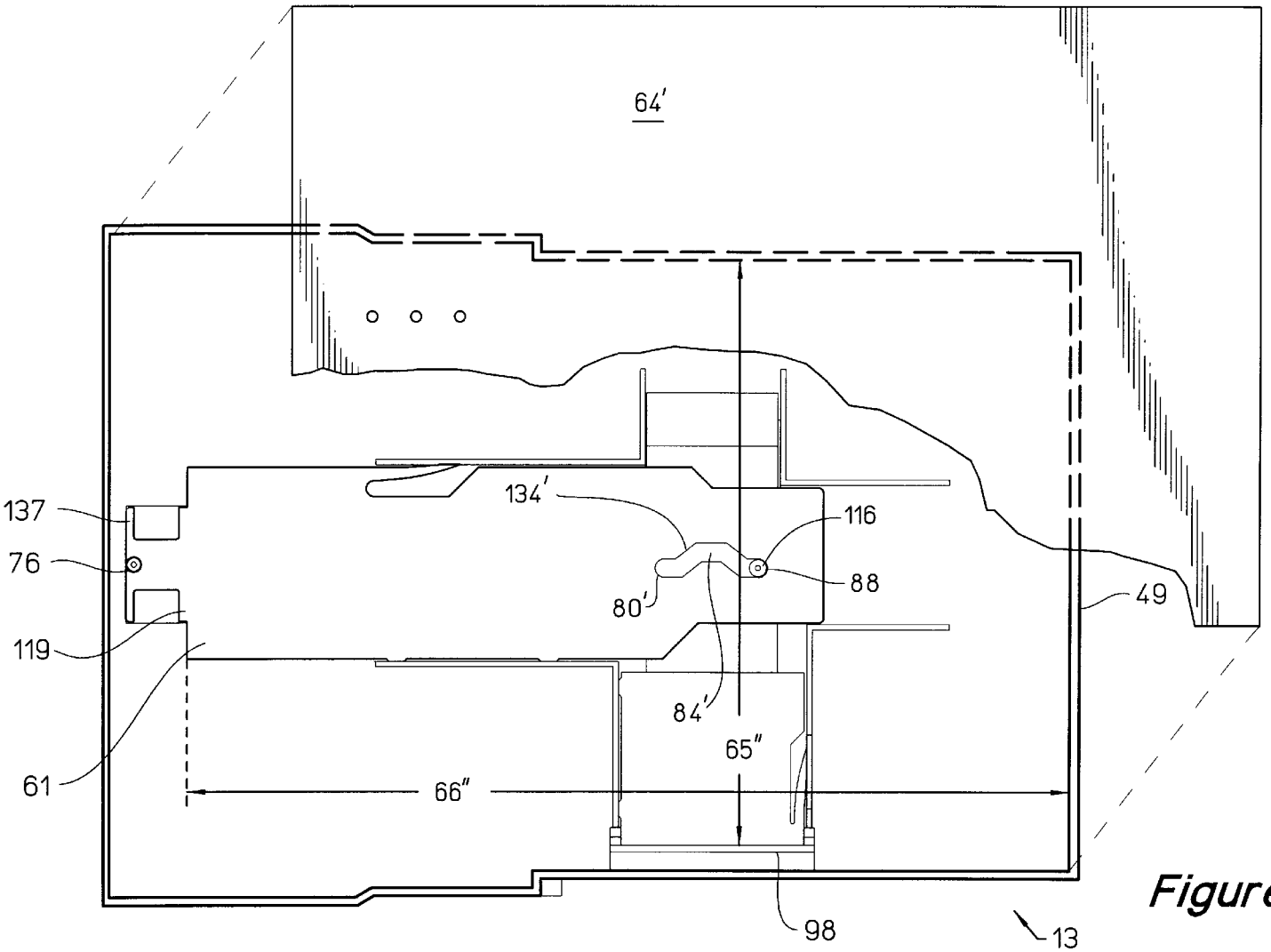
FIG. 9 is bottom plan view of an alternative embodiment of the paper supply tray of FIG. 1 in "legal" size position.

FIG. 9 illustrates an alternative embodiment of the present invention. For the two embodiments like reference numerals indicate like components. FIG. 9 illustrates a cam surface 134' designed to accommodate "legal" size paper in addition to "A" and "A4" sizes. The cam surface 134' has an obtuse angle between a first paper adjustment position 80' and a second adjustment position 84', and a second obtuse angle between the second paper adjustment position 84' and a third paper adjustment position 88. The paper adjustment positions 80', 84', and 88 refer to "A", "A4", and "legal" sizes of paper, respectively. In FIG. 9, the cam follower 116 is positioned in the cam surface 134' to accommodate "legal" size paper, as indicted by reference numeral 88. In the "legal" size position, the inside dimensions 65" and 66" are about 8½ and 14 inches respectively. A corresponding "legal" size engagement slot 73 for engaging the anchoring pin 76 is located on a base 64' as illustrated in FIG. 9.

As can be appreciated, the invention is designed to accommodate many sizes of paper and other media. Furthermore, another alternative embodiment can easily be designed such that the side wall paper guide 58 contains the cam surface 134 and the front wall paper guide 61 contains the cam follower 116. In addition, the cam surface 134 can be designed to accommodate papers having a variety of dimensions. Although, specific embodiments of the invention have been described and illustrated, the invention is not to be limited to the specific forms or arrangement of parts so described and illustrated. The invention is limited only by the claims.

I claim:

1. A paper size adjusting apparatus for a paper supply tray, comprising:

a paper supply tray having a generally rectangular shaped base, bottom wall, left and right side walls, a front wall and a rear wall, said walls being immovable with respect to each other, said bottom wall spaced apart from said base and having a top surface and a bottom surface;

one pair of parallel spaced apart alignment rails attached to said bottom wall;

a side wall paper guide supported by said base said side wall paper guide laterally movable with respect to and connected to the supply tray;

a front wall paper guide supported by said base said front wall paper guide longitudinally movable with respect to and connected to the supply tray;

an arcuate spring member attached to one of said paper guides said spring member constrains the associated paper guide in sliding frictional engagement within said spaced apart alignment rails; and a mechanical connector that engages both paper guides in a manner so that movement of one guide generates corresponding movement of the second guide, thereby adjusting the tray for papers of differing sizes.

2. The apparatus of claim 1 wherein the one pair of alignment rails extends in a lateral direction relative to said base; and the arcuate spring member is attached to the side wall paper guide, said arcuate spring member constrains the side wall paper guide in sliding frictional engagement within the lateral alignment rails.

3. The apparatus of claim 1 wherein the one pair of alignment rails extends in a longitudinal direction relative to said base; and the arcuate spring member is attached to the front wall paper guide, said arcuate spring member constrains the front wall paper guide in sliding frictional engagement within the longitudinal alignment rails.

4. The apparatus of claim 1 further including at least two alignment shoulders on the one paper guide having the arcuate spring member, said alignment shoulders provide friction contact between the one paper guide and one of the rails of the said one pair of alignment rails.

5. The apparatus of claim 1 further including another pair of spaced apart alignment rails attached said bottom wall; wherein the one pair of alignment rails extends in a lateral direction relative to said base;

the arcuate spring member is attached to the side wall paper guide, said arcuate spring member constrains the side wall paper guide in sliding frictional engagement within the lateral alignment rails;

the another pair of spaced apart alignment rails extends in a longitudinal direction relative to said base; and another arcuate spring member attached to said front wall paper guide, said another arcuate spring member constrains the front wall paper guide in sliding frictional engagement within the longitudinal alignment rails.

6. The apparatus of claim 5 wherein both sets of alignment rails are attached to and depend downwardly from said bottom surface of the bottom wall.

7. A paper size adjusting apparatus for a paper supply tray, comprising:

a paper supply tray having a generally rectangular shaped base, bottom wall, left and right side walls, a front wall and a rear wall, said walls being immovable with respect to each other, said bottom wall spaced apart from said base and having a top surface and a bottom surface;

one pair of parallel spaced apart alignment rails attached to said bottom wall;

a side wall paper guide supported by said base, said side wall paper guide laterally movable with respect to and connected to the supply tray, said side wall paper guide having a side wall paper guide shelf extending generally in a lateral direction relative to said base and having a top and a bottom surface, the top surface of the said shelf occupying a common plane with the top surface of said bottom wall;

a front wall paper guide supported by said base, said front wall paper guide longitudinally movable with respect to and connected to the supply tray, said front wall paper guide having a front wall paper guide shelf extending generally in a longitudinal direction relative to said base and having a top and a bottom surface, the top surface of the said shelf occupying a common plane with the top surface of said bottom wall, such that a medium sheet is positionable on a flat plane that includes the top surface of the side wall paper guide shelf and the top surface of the front wall paper guide shelf and the top surface of the bottom wall;

one of said paper guides in sliding engagement within said one pair of spaced apart alignment rails; and a mechanical connector that engages both paper guides in a manner so that movement of one guide generates corresponding movement of the second guide, thereby adjusting the tray for papers of differing sizes.

8. The apparatus of claim 7 further including:

another pair of spaced apart alignment rails attached to said bottom wall;

wherein the one pair of alignment rails extends in a lateral direction relative to said base;

an arcuate spring member attached to said side wall paper guide, said spring member constrains the side wall paper guide in sliding frictional engagement within said spaced apart lateral alignment rails;

the another pair of spaced apart alignment rails extends in a longitudinal direction relative to said base; and another arcuate spring member attached to said front wall paper guide, said another spring member constrains the front wall paper guide in sliding frictional engagement within said spaced apart longitudinal alignment rails.

9. A paper size adjusting apparatus for a paper supply tray, comprising:

a paper supply tray having a generally rectangular shaped base, bottom wall, left and right side walls, a front wall and a rear wall, said walls being immovable with respect to each other, said bottom wall spaced apart from said base and having a top surface and a bottom surface;

a generally rectangular shaped opening extending through said bottom wall having a width dimension and a length dimension, said dimensions extending generally relative to said base;

a side wall paper guide supported by said base, said side wall paper guide laterally movable with respect to and connected to the supply tray;

a front wall paper guide supported by said base, said front wall paper guide longitudinally movable with respect to and connected to the supply tray;

one of said paper guides having an upstanding paper guide panel extending substantially above the top surface of said bottom wall for facilitating the alignment of at least one medium sheet at one dimension;

said one paper guide further having a paper guide shelf integrally connected to said paper guide panel and extending perpendicularly therefrom and having a width dimension about equal to the width dimension of said opening to form a smooth coextending surface with the top surface of said bottom wall for supporting from below said at least one medium sheet, said one paper guide further including a pair of horizontally extending paper guide fins extending from and depressed with respect to said paper guide shelf and having a width gauge dimension substantially greater than the width dimension of said opening, said one paper guide further including a paper guide mantel extending from and depressed with respect to said paper guide shelf and having a width dimension substantially greater than the width dimension of said opening, the paper guide fins and the paper guide mantel positioned between said bottom wall and said base thereby capturing said one paper guide therebetween;

a cam follower pin extending downwardly from one of the paper guides and a cam surface within the other paper guide, said cam follower pin and said cam surface defining a cam system for mechanically coupling said side wall paper guide and said front wall paper guide to one another such that movement of either in a horizontal direction causes relative horizontal orthogonal movement in the other thereby adjusting the tray for papers of differing sizes.

10. A paper size adjusting apparatus for a paper supply tray, comprising:

a paper supply tray having a generally rectangular shaped base, bottom wall, left and right side walls, a front wall and a rear wall, said walls being immovable with respect to each other, said bottom wall spaced apart from said base and having a top surface and a bottom surface;

a generally rectangular shaped side wall opening extending through said bottom wall having a width dimension and a length dimension, said length dimension extending generally in a lateral direction relative to said base;

a side wall paper guide supported from below by said base and received in said side wall opening, said side wall paper guide laterally movable with respect to and connected to the supply tray;

said side wall paper guide having an upstanding side wall paper guide panel extending substantially above the top surface of said bottom wall for facilitating the alignment of at least one medium sheet at its lateral dimension;

said side wall paper guide further having a side wall paper guide shelf integrally connected to said side wall paper guide panel and extending perpendicularly therefrom and having a width dimension about equal to the width dimension of said side wall opening to form a smooth coextending surface with the top surface of said bottom wall for supporting from below said at least one medium sheet, said side wall paper guide further including a pair of horizontally extending side wall paper guide fins extending from and depressed with respect to said side wall paper guide shelf and having a width gauge dimension substantially greater than the width dimension of said side wall opening, said side wall paper guide further including a side wall paper guide mantel extending from and depressed with respect to said side wall paper guide shelf and having a width dimension substantially greater than the width dimension of said side wall opening, the side wall paper guide fins and the side wall paper guide mantel positioned between said bottom wall and said base thereby capturing said side wall paper guide therebetween;

a generally rectangular shaped front wall opening extending through said bottom wall and spaced apart from said side wall opening, said front wall opening having another width dimension and another length dimension, said another length dimension extending generally in a longitudinal direction relative to said base;

a front wall paper guide supported from below by said base and received in said front wall opening, said front wall paper guide longitudinally movable with respect to and connected to the supply tray;

said front wall paper guide having an upstanding front wall paper guide panel extending substantially above the top surface of said bottom wall for facilitating the alignment of said at least one medium sheet at its longitudinal dimension;

said front wall paper guide further having a front wall paper guide shelf integrally connected to said front wall paper guide panel and extending perpendicularly therefrom and having a width dimension about equal to the width dimension of said front wall opening to form a smooth coextending surface with the top surface of said bottom wall for supporting from below said at least one medium sheet, said front wall paper guide further including a pair of horizontally extending front wall paper guide fins extending from and depressed with respect to said front wall paper guide shelf and having a width gauge dimension substantially greater than the width dimension of said front wall opening, said front wall paper guide further including a front wall paper guide mantel extending from and depressed with respect to said front wall paper guide shelf and having a width dimension substantially greater than the width dimension of said front wall opening, the front wall paper guide fins and the front wall paper guide mantel positioned between said bottom wall and said base thereby capturing said front wall paper guide therebetween; and a cam follower pin extending downwardly from one of the paper guides and a cam surface within the other paper guide, said cam follower pin and said cam surface defining a cam system for mechanically coupling said side wall paper guide and said front wall paper guide to one another such that movement of either in a horizontal direction causes relative horizontal orthogonal movement in the other thereby adjusting the tray for papers of differing sizes.

11. The apparatus of claim 10 further including:

one pair of alignment rails attached to and depending downwardly from said bottom surface of the bottom wall; and an arcuate spring member attached to one of said paper guides, said spring member constrains the associated paper guide in sliding frictional engagement within said spaced apart alignment rails.

12. The apparatus of claim 11 further including another pair of spaced apart alignment rails attached to and depending downwardly from said bottom surface of the bottom wall; wherein the one pair of alignment rails extends in a lateral direction relative to said base;

the arcuate spring member is attached to the side wall paper guide, said arcuate spring member constrains the side wall paper guide in sliding frictional engagement within the lateral alignment rails;

the another pair of spaced apart alignment rails extends in a longitudinal direction relative to said base; and another arcuate spring member attached to said front wall paper guide, said another arcuate spring member constrains the front wall paper guide in sliding frictional engagement within the longitudinal alignment rails.

13. The apparatus of claim 12 further including:

a second pair of alignment rails extending in a lateral direction relative to said base, said two pairs of lateral alignment rails having substantially different width gauge dimensions, wherein one pair of the lateral alignment rails has a width gauge dimension about equal to the width dimension of said side wall opening and wherein the other pair of the lateral alignment rails has a width gauge dimension substantially greater than the width dimension of said side wall opening; and a second pair of alignment rails extending in a longitudinal dimension relative to said base, said two pairs of longitudinal alignment rails having substantially different width gauge dimensions, wherein one pair of the longitudinal alignment rails has a width gauge dimension about equal to the width dimension of said front wall opening and wherein the other pair of the longitudinal alignment rails has a width gauge dimension substantially greater than the width dimension of said front wall opening.

* * * * *

UNITED STATES PATENT AND TRADEMARK OFFICE

CERTIFICATE OF CORRECTION

PATENT NO. : 5,901,952
DATED : May 11, 1999
INVENTOR(S) : Arjang Hourtash

It is certified that error appears in the above-identified patent and that said Letters Patent is hereby corrected as shown below:

Column 5,
Line 2, delete "131" and insert -- 200 --.

Signed and Sealed this

Eleventh Day of March, 2003

JAMES E. ROGAN
*Director of the United States Patent and Trademark Office*